United States Patent [19]

Luca'

[11] 4,239,281

[45] Dec. 16, 1980

[54] CHAIR OR SOFA CONVERTIBLE INTO A BED

[75] Inventor: Sebastiano Luca', Barba, Italy

[73] Assignee: Lukas Beddy di Luca Sebastiano & C.S.a.s., Barba, Italy

[21] Appl. No.: 35,046

[22] Filed: May 1, 1979

[51] Int. Cl.[2] ..... A47C 17/10

[52] U.S. Cl. ..... 297/108; 5/45; 5/13

[58] Field of Search ..... 297/105, 108, 111; 5/13, 45, 46

[56] References Cited

U.S. PATENT DOCUMENTS

| | | | |
|---|---|---|---|
| 2,467,638 | 4/1949 | Thomas | 297/111 |
| 2,632,897 | 3/1953 | Thomas | 297/111 X |
| 3,654,642 | 4/1972 | Barabas | 297/105 |
| 3,813,710 | 6/1974 | Janko | 5/13 |
| 4,080,672 | 3/1978 | Eakins | 5/13 |
| 4,135,264 | 1/1979 | Busnelli | 5/45 |

*Primary Examiner*—Roy D. Frazier
*Assistant Examiner*—Peter A. Aschenbrenner
*Attorney, Agent, or Firm*—Sughrue, Rothwell, Mion, Zinn & Macpeak

[57] ABSTRACT

A mechanism for a chair or sofa which is convertible into a bed comprises a fixed frame to which is pivotally attached an articulated movable frame made up of three sub-frames a first of which is pivotally connected at one end to the fixed frame, a second of which is suspended within the fixed frame by links and levers attached to the first sub-frame, and the third of which is pivotally attached to the first sub-frame. When the mechanism is folded up for use as a chair or sofa the second sub-frame lies below the first and within the fixed frame. When the mechanism is opened out as a bed the first sub-frame is turned to a horizontal position and the second sub-frame is raised to the same horizontal level thereas by the linkages and lever systems from which it is suspended.

4 Claims, 4 Drawing Figures

CHAIR OR SOFA CONVERTIBLE INTO A BED

The present invention relates generally to a frame mechanism for an armchair or sofa which is convertible into a bed, and particularly to such a mechanism of the type including a fixed frame, for providing a rigid support, and a movable articulated frame which carries the upholstery, that is the seat and the chair back fixed on one side of the movable frame, which is outermost when the mechanism is in the position for use as an arm chair and, on the opposite side, the mattress, which is uppermost when the mechanism is in the position for use as a bed. In such a mechanism the movable frame is hinged to the fixed frame in such a way as to be able to rotate in one direction or the other through 180° about a longitudinal axis between two end positions one of which it occupies when the mechanism is arranged for use as an armchair and the other of which it occupies when the mechanism is arranged for use as a bed.

Although the mechanism of the invention is equally applicable for the formation of a chair, which can convert into a single bed, or for the formation of a sofa or settle, which can convert into a double bed, it will be further described hereinafter for convenience purely in relation to its application as a convertible chair/single bed without by this detracting from its wider, more general, applicability.

In known types of convertible chair the connection between the fixed frame and the movable frame is obtained by means of a plurality of levers which, with the aid of springs, operate to balance the forces required to be applied to the mechanism in order to convert it from the relative orientation of its parts for use as a chair to the relative orientation of its parts for use as a bed. The springs also help to render the conversion operation as automatic as possible.

The use of springs for such purpose, however, involves various notable constructional complications in the structure of the mechanism, the most disadvantageous of which is the lateral bulk of the lever systems due to the space required to accommodate the springs.

The primary object of the present invention is to provide a mechanism for a convertible armchair/bed of the general type referred to above, which, as well as being of simple and robust construction, also permits a reduction in the lateral bulk of the lever systems.

Another object of the present invention is to provide a mechanism for a convertible armchair/bed in which almost the whole of the available space within the outline of the mechanism is available for the use as a bed.

A further object of the present invention is to be able to maintain within acceptable limits the dimensions of the mechanism when arranged as an armchair without having to reduce the dimensions of the mechanism when arranged as a bed.

Yet another object of the present invention is to provide a mechanism for a convertible armchair bed of the above mentioned type, in which there is a smaller number of parts than comparable such mechanisms of the known type.

Yet a further object of the present invention is to provide a mechanism for a convertible armchair/bed which has the greatest possible stability in the two different positions of use.

Still a further object of the present invention is to provide a convertible armchair/bed, in which the conversion operation required in order to convert the mechanism from one to the other of the two uses is a simple and convenient operation which does not require the application of excessively high muscular forces whilst nevertheless not requiring the help of springs to balance the forces involved.

The above objects are achieved according to the present invention by a mechanism for an armchair or couch convertible into a bed, of the type including a fixed support frame and an articulated movable frame pivotally attached thereto and movable by rotation about the pivotal attachment between two end positions in the first of which it is arranged for use as a chair or couch and in the second of which it is arranged for use as a bed, the movable frame carrying on one face an upholstery seat and seat back for use when the mechanism is arranged as an armchair and on the opposite face a mattress for use when the mechanism is arranged as a bed, characterised in that the movable frame comprises at least two sub-frames, one of which is pivotally mounted at one end thereof on the fixed frame by main pivots and the other of which is suspended at one end by a lever at each side thereof, from the said one sub-frame, and at the other end by a system of levers at each side thereof, from the fixed frame, the said systems of levers being also connected to the said one sub-frame and the arrangement being such that when the mechanism is in the position for use as a chair or couch said other sub-frame lies below said one sub-frame, and when said one sub-frame is turned about said main pivot connecting it to said fixed frame, said levers at the said one end of said other sub-frame and the system of levers at the other end of the said other sub-frame raise it to a position substantially level with said one sub-frame and coplanar therewith.

Further characteristics and advantages of the invention will become more apparent from a reading of the description which follows, in which reference is made to the accompanying drawings, provided purely by way of non-restrictive example, in which.

Figure 1:
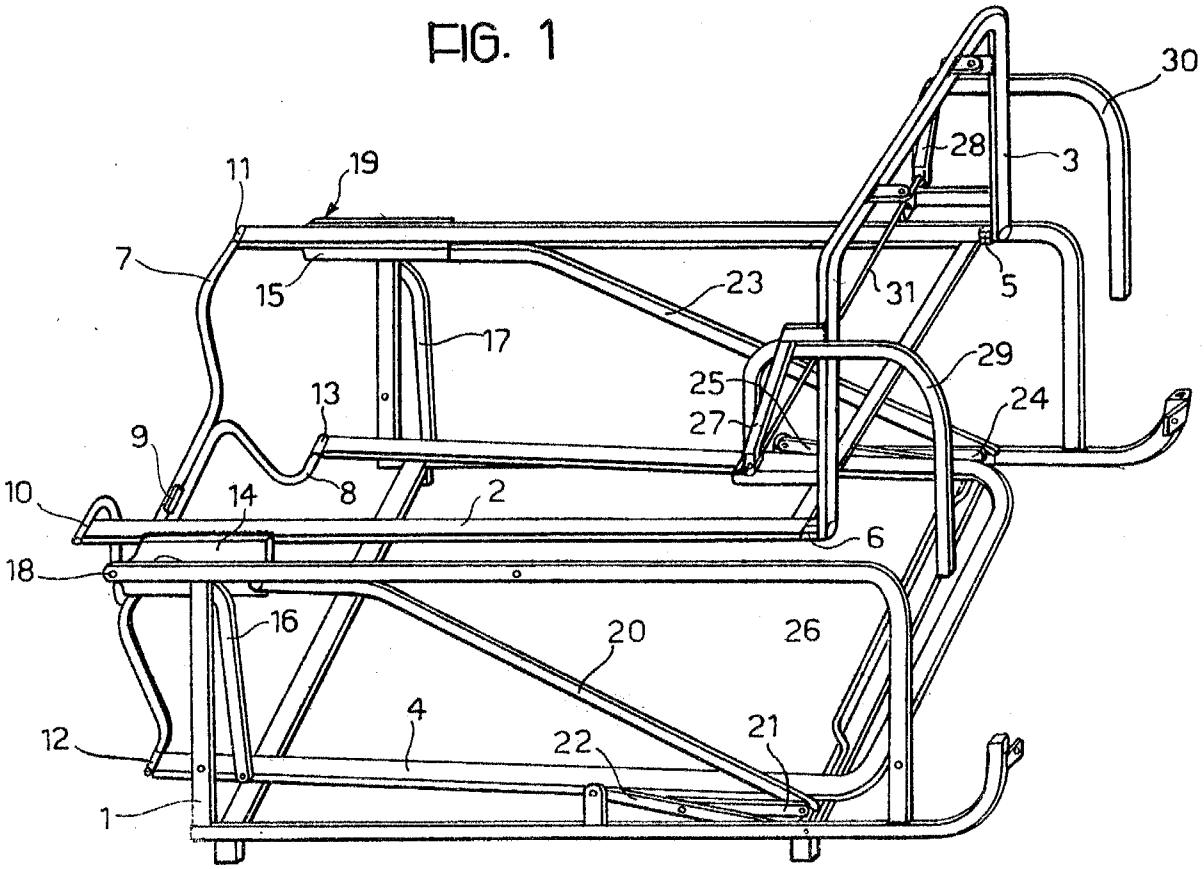
FIG. 1 is a perspective view of the framework of the novel convertible armchair/bed mechanism, illustrated in the position suitable for use as an armchair.

Referring now to the drawings, the novel convertible armchair/bed mechanism of the invention comprises basically a fixed frame 1 which serves a static support function, for carrying both a movable frame, which will be discussed further below, and also any parts of wood, possibly covered in textile or other upholstery material, which constitute the visible parts of the armchair and which can have any desired aesthetic conformation. The movable frame carried on the fixed frame is composed of three main sub-frames which are made from bent welded tubes. The first sub-frame 2 is generally U-shape and is connected to a second sub-frame 3, which is generally C-shape, by means of two hinges 5 and 6 at the ends of the arms thereof, which hinges allow these two sub-frames a relative rotation of 90°.A third sub-frame 4, which is also U-shaped, is connected to the U-shape first sub-frame by means of upper and lower shaped crosspieces 7 and 8, which latter are joined together by a hinge 9 at a mid-point thereof. The upper shaped crosspiece 7 is engaged with the ends of the arms of the first sub-frame 2 by respective pivots 10 and 11, and the lower shaped crosspiece 8 is engaged with the ends of the arms of the third sub-frame 4 by two pivots 12 and 13.

Adjacent the ends of the arms of the first sub-frame 2 there are welded two plates 14 and 15, one on the right arm and one on the left arm. Two shaped levers 16 and 17 pivoted at one end respectively to the plates 14 and 15 and at the other end respectively to the right arm and to the left arm of the third sub-frame 4 constitute a further connection between the first sub-frame 2 and the third sub-frame 4.

The articulated movable frame constituted by the three sub-frames 2,3 and 4 is connected to the fixed frame 1 by means of two cylindrical hinges 18 and 19 on the two plates 14 and 15, which hinges permit a relative rotation of 180° between the first sub-frame 2 and the fixed frame 1. In addition the plate 14 secured to the right arm of the first sub-frame 2 of the movable frame is connected to a mid point of a lower rail of the fixed frame by means of the system of linkage levers 20, 21, 22. Likewise the plate 15 secured to the left arm of the first sub-frame 2 of the movable frame is connected to the corresponding point of the corresponding lower rail of the fixed frame 1 by means of a system of linkage levers 23, 24, 25. The two end levers 22 and 25 are connected together by a crosspiece 26 which passes under the rear end of the U-shape third sub-frame 4.

To the second sub-frame 3 of the movable frame are welded two arms 27 and 28 on which are hinged, with the possibility of relative movement of 180° , two tubular bent pieces 29 and 30 connected together by means of a crosspiece 31; these bent pieces 29 and 30 constitute the resting feet for the rear parts of the mechanism when in the position for use as a bed.

The sub-frames 2, 3 and 4 of the articulated movable frame are each provided with a spanning network or mesh of any suitable form for resiliently supporting the mattress when the mechanism is in the position for use as a bed; in addition the first sub-frame 2 also has a mesh or net for resiliently supporting the seat when the mechanism is in the position for use as an armchair. These meshes or nets have not been shown in the drawings for reasons of clarity.

Figure 2:
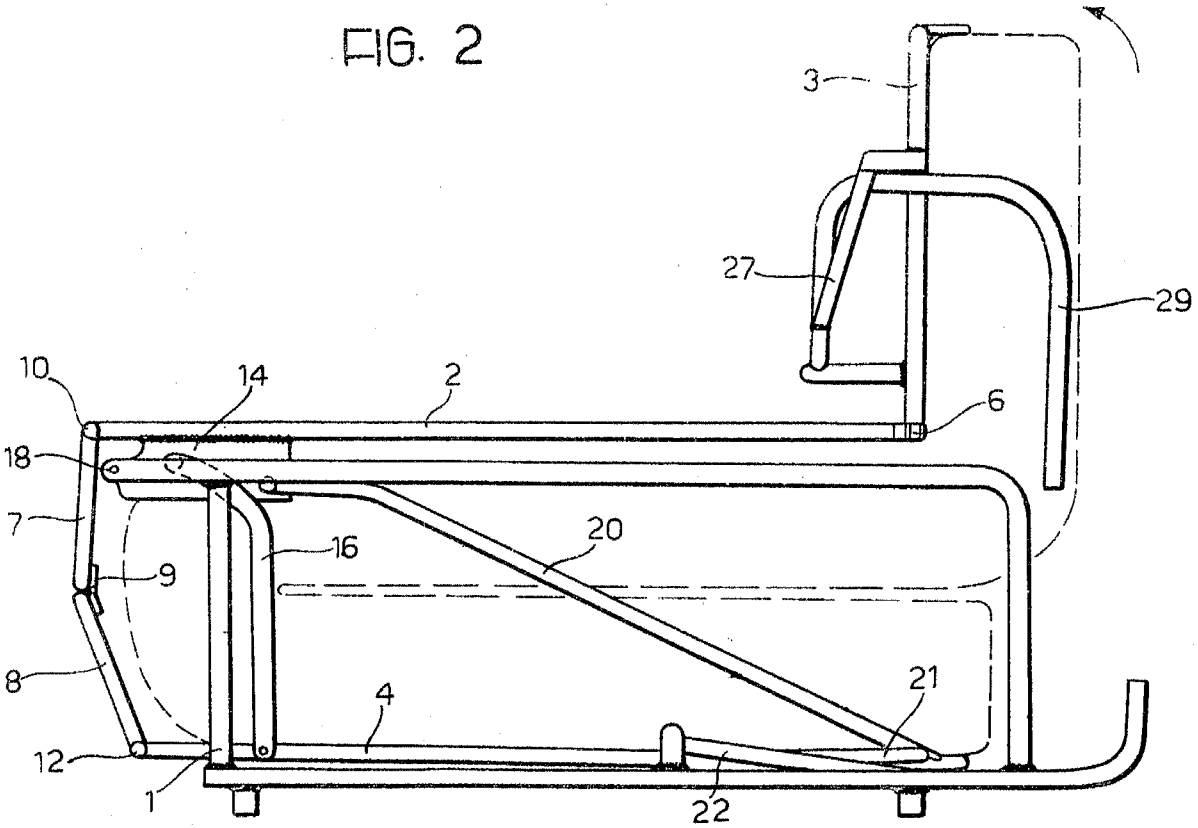
FIG. 2 is a schematic side view of the mechanism illustrated in FIG. 1, shown in the position for use as an armchair (the part shown in broken outline represents the shape of the mattress)
Figure 3:
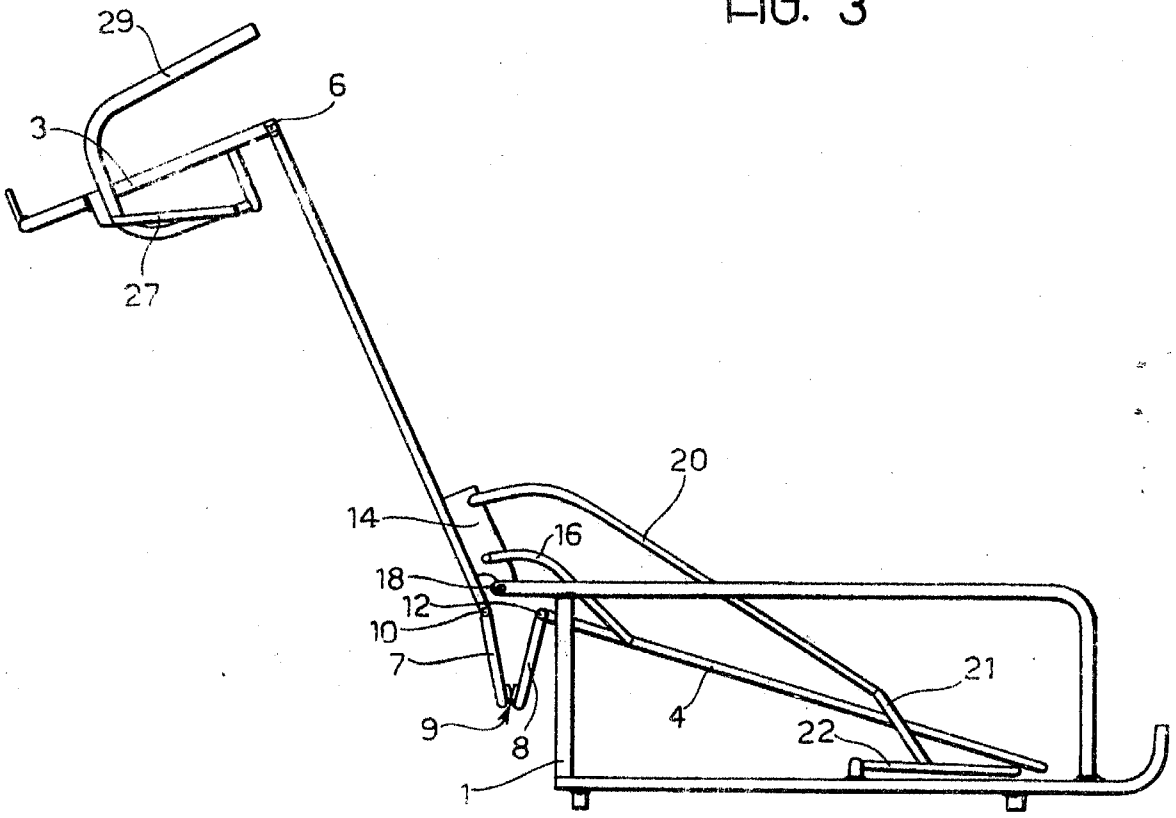
FIG. 3 is a schematic side view similar to FIG. 2, showing the mechanism in an intermediate position partway between the position for use as an armchair and the position for use as a bed.
Figure 4:
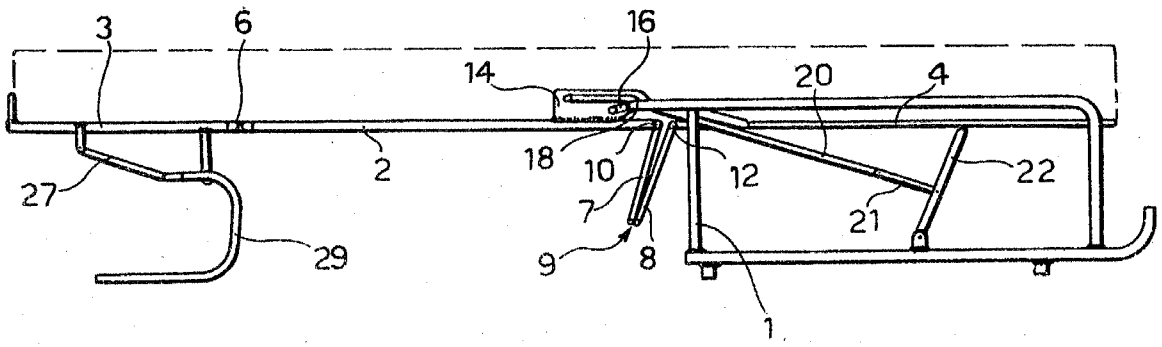
FIG. 4 is a schematic sideview, similar to FIG. 2 and 3, in which the mechanism is shown in the position of use as a bed (the part shown in broken outline again representing the shape of the mattress).

The conversion of the mechanism from the position for use as an armchair to the position for use as a bed is effected by rotating the movable frame in the direction indicated by the arrow of FIG. 2 until, passing through intermediate positions, one of which is illustrated in FIG. 3, it reaches the position illustrated in FIG. 4. In this position the second sub-frame 3 of the movable frame has been turned through 90° until it is substantially coplanar with the first sub-frame 2 thereof, and the feet 29 and 30 have been rotated, with respect to the second sub-frame 3, by 180°.

During this conversion operation, whilst the first and second sub-frames 2 and 3 of the movable frame are turning about the cylindrical hinges 18 and 19, the shaped levers 16 and 17 cause the front part of the third sub-frame 4 of the movable frame to rise until it is substantially at the same horizontal level as the first and second sub-frames 2 and 3 when they are fully rotated; contemporaneously the system of levers 20, 21 and 22, and their corresponding levers 23, 24 and 25 cause the crosspiece 26 to rise and this therefore lifts the rear part of the third-sub-frame 4 of the movable frame until it has been elevated to the same horizontal level as the front part of the third sub-frame 4. At this point the three sub-frames of the movable articulated frame are horizontal and coplanar, and the mattress which is fixed to them is substantially flat and horizontal.

The hinges 5 and 6, which connect the first sub-frame 2 and the second sub-frame 3 of the movable frame, in the position for use as a bed as shown in FIG. 4, have completed their permitted rotation (90° ) and therefore, since these hinges 5 and 6 are located at a midpoint of the composite unit formed by these two sub-frames, any loads which do not have any upward components of force, which will be the normal load applied to the bed, will not cause any tendency to folding of the sub-frames; this unit, which rests at one end on the feet 29 and 30 and at the other end on the fixed frame 1, joined to this latter by means of the cylindrical hinges 18 and 19, is therefore perfectly stable.

The rear part of the third sub-frame 4 of the movable frame rests on the crosspiece 26 which is rigidly held in place at its ends by means of the two systems of levers 20, 21, 22, and 23, 24, 25, which lock it against rising or falling. At the front end of the lever systems 20, 21, 22 and 23, 24 25, the levers 20 and 23 pivotally secured to the plates 14, 15, respectively, which plates, having turned through 180° in the conversion, lock two lever systems in position in the manner of a toggle linkage. The forward end of the third sub-frame 4 of the movable frame is supported by the levers 16 and 17 which, in the position illustrated in FIG. 4, lie with their intermediate curved regions over the axes of the hinges 18 and 19 and thus support the third sub-frame 4 in the raised position against any force which may be applied from above, such as would occur in normal use as a bed. In fact the only way to return the third sub-frame 4 to its lowered position is by raising both the first and second sub-frames 2 and 3 of the movable frame. However this can only be effected by deliberately applying external forces to these sub-frames; with the relative distribution of forces in play during use as a bed such raising is impossible.

The shaped intermediate crosspieces 7 and 8, which are joined together by the hinge 9 are displaced during the rotation from the position for use as an armchair to the position for use as a bed and draw close together allowing the first and third sub-frames 2 and 4 of the movable frame to approach one another closely: their function is that of transversely stiffening the sub-frames 2 and 4 of the movable frame to provide rigidity for the arms of these sub-frames against the tension due to the nets which support the mattress. The particular shape of these crosspieces avoids, however, the intrusion of rigid members into the upholstered regions both in the position for use as an armchair and, more importantly, in the position for use as a bed.

The conversion of the mechanism from the position for use as a bed to the position for use as an armchair is effected by performing, in the reverse order, the identical operations previously described, by raising the second sub-frame 3 and turning it about the hinges 5, 6 with respect to the first sub-frame 2.

As referred to earlier, although the mechanisms of the invention has been particularly described with reference to an embodiment formed as an armchair convertible into a single bed it can, simply by making the main frame and the sub-frames of the movable frame wider, easily be formed as a sofa or settle convertible into a double bed.

What is claimed is:

1. In a mechanism for an armchair or couch convertible into a bed, of the type including a fixed support frame, an articulated movable frame, pivotal attachment means pivotally attaching said movable frame to said fixed support frame, said pivotal attachment means permitting said movable frame to rotate thereabout between a first end position above said fixed frame and a second end position to one side of said fixed frame, said mechanism being adapted for use as a chair or couch when said movable frame is in said first position and being adapted for use as a bed when said movable frame is in said second position, an upholstery seat and seat back for use when said mechanism is arranged as an armchair being attached to said movable frame on one face thereof, and a mattress for use when said mechanism is arranged for use as a bed being attached to said movable frame on the other face thereof, the improvement wherein said movable frame includes first and second sub-frames, main pivot means pivotally mounting said first sub-frame at one end thereof to said fixed frame, lever means suspending one end of said second sub-frame, at each side thereof, from said first sub-frame, and lever system means suspending the other end of said second sub-frame, at each side thereof, from said fixed frame by means of a crosspiece connected at opposite ends to said lever system means and which passes underneath said other end of said second frame means without being fixedly connected thereto, said lever system means being also connected to said first sub-frame whereby when said mechanism is in said position for use as a chair or couch said second sub-frame lies below said first sub-frame and when said first sub-frame is turned about said main pivot means connecting it to said fixed frame said lever means at said first end of said second sub-frame and said lever means at said other end of said second sub-frame operate to raise said second sub-frame to a position substantially level with the said first sub-frame and coplanar therewith.

2. In a mechanism for a armchair or couch convertible into a bed, of the type including a fixed support frame, an articulated movable frame, pivotal attachment means pivotally attaching said movable frame to said fixed support frame, said pivotal attachment means permitting said movable frame to rotate thereabout between a first end position above said fixed frame and a second end position to one side of said fixed frame, said mechanism being adapted for use as a chair or couch when said movable frame is in said first position and being adapted for use as a bed when said movable frame is in said second position, an upholstery seat and seat back for use when said mechanism is arranged as an armchair being attached to said movable frame on one face thereof, and a mattress for use when said mechanism is arranged for use as a bed being attached to said movable frame on the other face thereof, the improvement wherein said movable frame includes first and second sub-frames, main pivot means pivotally mounting said first sub-frame at one end thereof to said fixed frame, lever means suspending one end of said second sub-frame, at each side thereof, from said first sub-frame, lever system means suspending the other end of said second sub-frame, at each side thereof, from said fixed frame, said lever system means being also connected to said first sub-frame whereby when said mechanism is in said position for use as a chair or couch said second sub-frame lies below said first sub-frame and when said first sub-frame is turned about said main pivot means connecting it to said fixed frame said lever means at said first end of said second sub-frame and said lever means at said other end of said second sub-frame operate to raise said second sub-frame to a position substantially level with the said first sub-frame and coplanar therewith, and stiffening crosspieces for said first sub-frame and said second sub-frame, said stiffening crosspieces extending across the width of said mechanism and being pivotally connected to a respective sub-frame at the ends thereof, said stiffening cross-pieces each having a generally U-shape central portion arranged to extend downwardly, whereby to provide the required stiffening without constituting rigid beams across the width of said mechanism, when said mechanism is arranged for use as a bed.

3. The mechanism of claim 2, wherein said stiffening cross-pieces are hinged together at a point intermediate their ends.

4. The mechanism of claim 2 or 3, wherein said third sub-frame carries a pair of feet pivotally attached thereto, said feet being turnable through 180° between an operative position occupied when said mechanism is arranged for use as a bed and a storage position occupied when said mechanism is arranged for use as a chair or couch.

* * * * *